US007448355B2

(12) United States Patent
Haze et al.

(10) Patent No.: US 7,448,355 B2
(45) Date of Patent: Nov. 11, 2008

(54) INTEGRATED POWER UNIT INCLUDING SPLIT CRANKCASE WITH REINFORCED FASTENING ARRANGEMENT, AND VEHICLE INCLUDING SAME

(75) Inventors: Hirotaka Haze, Saitama (JP); Naoki Kono, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/716,928

(22) Filed: Mar. 12, 2007

(65) Prior Publication Data

US 2007/0221160 A1 Sep. 27, 2007

(30) Foreign Application Priority Data

Mar. 27, 2006 (JP) ..... 2006-086352

(51) Int. Cl.
*F02B 75/22* (2006.01)

(52) U.S. Cl. ..... 123/195 R; 123/195 AC

(58) Field of Classification Search ..... 123/195 R, 123/195 AC

See application file for complete search history.

(56) References Cited

U.S. PATENT DOCUMENTS

| | | | | |
|---|---|---|---|---|
| 5,078,105 | A * | 1/1992 | Ito et al. | 123/195 AC |
| 5,860,404 | A | 1/1999 | Tanaka | |
| 2003/0041815 | A1 | 3/2003 | Kawakubo et al. | |
| 2005/0016488 | A1 * | 1/2005 | Kawakubo et al. | 123/192.2 |
| 2006/0169224 | A1 | 8/2006 | Lenz et al. | |

FOREIGN PATENT DOCUMENTS

| | | |
|---|---|---|
| DE | 4012475 | 10/1990 |
| DE | 19803242 | 8/1998 |
| EP | 1288460 | 5/2003 |
| EP | 1676989 | 7/2006 |
| GB | 187425 | 10/1922 |
| JP | 02-13688 | 4/1990 |

OTHER PUBLICATIONS

U.S. Appl. No. 11/711,268, filed Feb. 27, 2007.
U.S. Appl. No. 11/711,269, filed Feb. 27, 2007.
U.S. Appl. No. 11/711,463, filed Feb. 27, 2007.

* cited by examiner

*Primary Examiner*—Noah Kamen
(74) *Attorney, Agent, or Firm*—Carrier, Blackman & Associates, P.C.; William D. Blackman; Joseph P. Carrier

(57) ABSTRACT

An integrated power unit for a small vehicle is configured to permit a compact engine design in a power unit having a crankcase that is split into upper and lower portions. The power unit includes a crankshaft supported by the crankcase and oriented transverse to the running direction of the vehicle. A transmission shaft is rotatably supported in a transmission chamber formed on the rear side of the crank chamber. The respective split surfaces of the upper and the lower crankcase portions are provided plural fastening boss portions arranged as vertically opposed pairs. The plural fastening boss portions are respectively joined using fastening bolts to integrate the upper crankcase and the lower crankcase, thereby forming the crankcase. A clutch is disposed at one end of the transmission shaft, and the rearmost fastening boss portions overlap with a rear portion of the clutch in the front-rear direction of the vehicle.

16 Claims, 9 Drawing Sheets

INTEGRATED POWER UNIT INCLUDING SPLIT CRANKCASE WITH REINFORCED FASTENING ARRANGEMENT, AND VEHICLE INCLUDING SAME

CROSS-REFERENCE TO RELATED APPLICATIONS

The present invention claims priority under 35 USC 119 based on Japanese patent application No. 2006-086352, filed on Mar. 27, 2006. The subject matter of this priority document is incorporated by reference herein.

BACKGROUND OF THE INVENTION

1. Field of the Invention

The present invention generally relates to an integrated power unit for a small-type vehicle such as a motorcycle, wherein the integrated power unit includes an engine and a transmission, and has a crankcase which is split into upper and lower sections. The present invention particularly relates to an improved positioning of fastening bosses on a crankcase, the fastening bosses permitting fastening via fastening bolts of an upper crankcase to a lower crankcase.

2. Description of the Background Art

It is well known in the art to provide motorcycle engine having a crankcase which is split so as to provide an upper crankcase portion and a lower crankcase portion. An example of a motorcycle engine which includes such a split crankcase is disclosed in Japanese Utility Model Publication No. Hei 2-13688.

The internal combustion engine disclosed in Japanese Utility Model Publication No. Hei 2-13688 has a configuration wherein a plurality of fastening bosses are provided. The fastening bosses receive fastening bolts for fastening together an upper crankcase portion and a lower crankcase portion. The fastening bosses are positioned on the crankcase such that the fastening bolts are located rearward of a multiple disk friction clutch provided at one end of a transmission shaft, and do not overlap with the multiple disk friction clutch. Instead, the fastening bosses are positioned so that the fastening bolts are spaced rearwards relative to the multiple disk friction clutch in the vehicle front-rear direction.

In this configuration, the fastening bosses, positioned on the back side of the multiple disk friction clutch, are also not overlapping with, but instead are spaced rearward from, a driven gear which is integral with an outer member of the multiple disk friction clutch and which is larger in diameter than the outer member.

The above described configuration makes it difficult to contrive a more compact design of the vehicle body on the rear side, relative to an internal combustion engine mounted on a small-type vehicle.

The present invention has been made in consideration of the above-mentioned drawback in the configuration of a conventional crankcase. Accordingly, it is an object of the present invention to provide an integrated power unit for a small-type vehicle such that, when a split crankcase of the integrated power unit is mounted on the small-type vehicle, a compact vehicle body design is provided on the rear side relative to the integrated power unit.

SUMMARY

In order to attain the above-described object, a first aspect of the invention relates to an integrated power unit for a small vehicle. The power unit includes a crankcase enclosing crank chamber and rotatably supporting a crankshaft. The crankshaft is oriented in the left-right direction of the vehicle, that is, orthogonal to the forward traveling direction of the vehicle. The crankcase also forms a transmission chamber on the rear side of the crank chamber, the transmission chamber rotatably supporting a transmission shaft. The crankcase is split into an upper crankcase and a lower crankcase, and the confronting surfaces of the upper crankcase and the lower crankcase are provided with plurality of vertically-opposed pairs of fastening boss portions. The plurality of fastening boss portions are fastened respectively by fastening bolts to integrate the upper crankcase and the lower crankcase, thereby forming the unitary crankcase. In addition, the power unit includes a clutch that permits connection and disconnection of power of the crankshaft to and from the transmission shaft. The clutch is disposed at one end of the transmission shaft, and the fastening boss portions at a rearmost portion of the plurality of fastening boss portions are so located as to overlap with a rear portion of the clutch in the front-rear direction of the vehicle.

A second aspect of the invention is related to the integrated power unit for a small vehicle in accordance with the first aspect thereof, and further relates to the clutch. The clutch includes a driven gear meshed with a drive gear provided on the crankshaft side. In addition, the clutch includes a clutch mechanism. The outside diameter of the driven gear is greater than the outside diameter of the clutch mechanism. Moreover, the fastening boss portions corresponding to the fastening boss portions at the rearmost portion of the plurality of fastening boss portions are located on the back side of the clutch, and are formed at the same positions as crank pins of the crankshaft, which is rotatably supported on the confronting surfaces of the crankcase, as viewed in the crankshaft direction.

According to the integrated power unit for a small vehicle as set forth in the first aspect of the invention, the fastening boss portions at the rearmost portion of the plurality of pairs of fastening boss portions, are located at such positions as to overlap a rear portion of the clutch in the vehicle front-rear direction. Therefore, it is possible to shorten the length of rear end of the crankcase so that the rear side of the crankcase is closer to the front side of the power unit, whereby the design of the vehicle body on the rear side relative to the internal combustion chamber is more compact than that of a conventional power unit.

According to the integrated power unit for a small vehicle as set forth in the second aspect of the invention, the outside diameter of the driven gear, which together with the clutch mechanism forms the clutch, is set greater than the outside diameter of the clutch mechanism. In addition, the fastening boss portions, which are the fastening boss portions at the rearmost portion and which are located on the back side of the clutch, are formed at the same positions as the crank pins of the crankshaft, as seen when the power unit is viewed in the crankshaft direction. Therefore, at the time of mounting the clutch onto the transmission shaft, the driven gear can be mounted onto the transmission shaft in the manner of riding over the fastening boss portions while simultaneously releasing it into the space between the crank webs provided with the crank pins. Thus, ease of mounting the clutch on the transmission shaft is maintained.

In addition, since the fastening portions of the crankcase are set at positions close to a corner portion of the crankcase, the fastening forces for the crankcase are enhanced.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

DETAILED DESCRIPTION

A selected illustrative embodiment of the invention will now be described in some detail, with reference to FIGS. 1 to 11. It should be understood that only structures considered necessary for clarifying the present invention are described herein. Other conventional structures, and those of ancillary and auxiliary components of the system, are assumed to be known and understood by those skilled in the art. In the following description, the forward travel direction of the vehicle is referred to as forward (front), the opposite direction is referred to as rearward (rear), and the respective left-hand and right-hand directions and/or sides are as viewed from a forward-facing vehicle operator.

Figure 1:
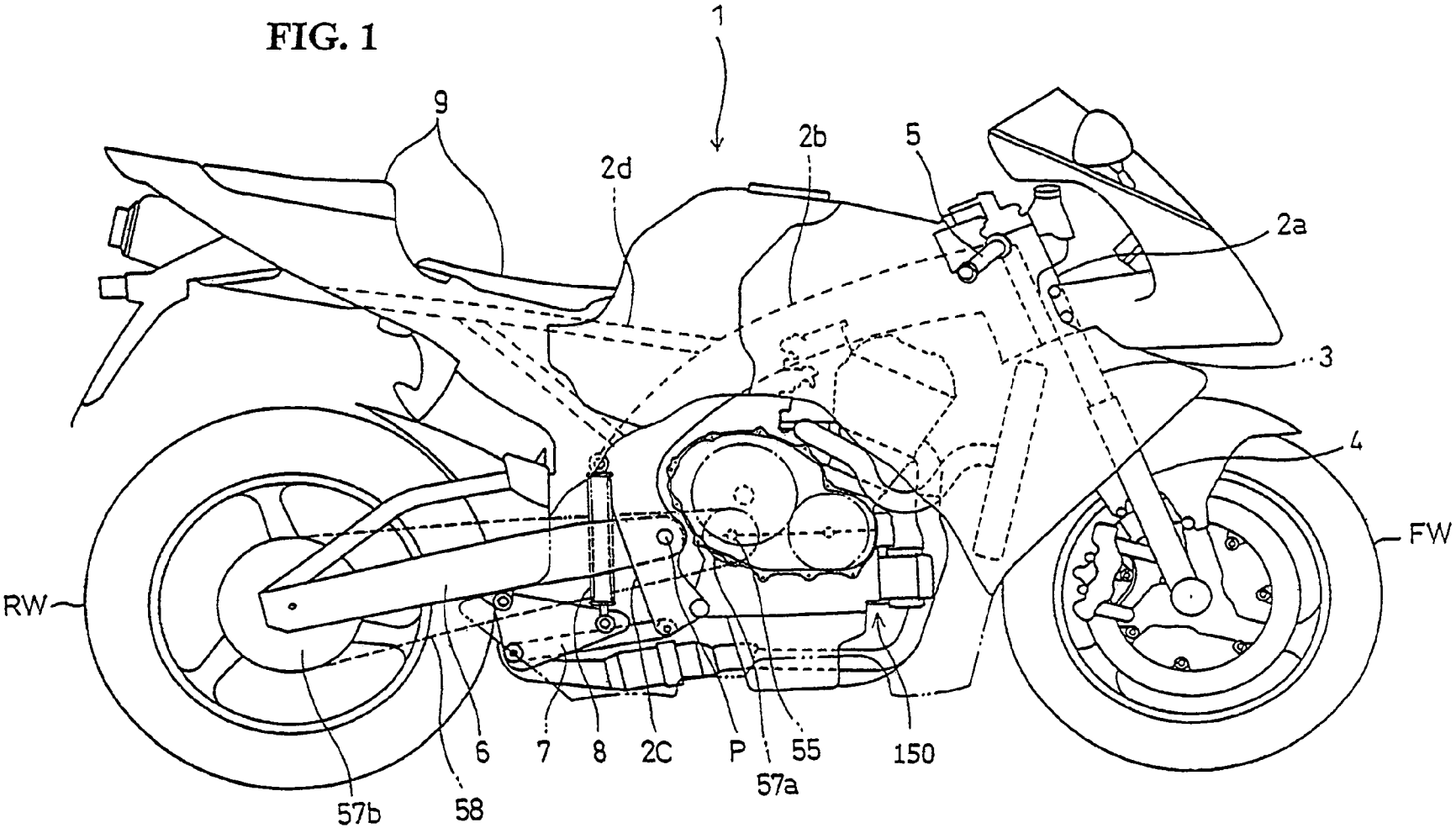
FIG. 1 is an overall right side view of a motorcycle on which an integrated power unit according to an embodiment of the present invention is mounted.

The above described small vehicle, on which the inventive integrated power unit 150 is mounted, is embodied by a motorcycle 1. An overall right side view of the motorcycle 1 is shown in FIG. 1.

A vehicle body frame of the motorcycle 1 has a configuration in which a main frame 2*b* extends rearward and slightly downward from a head pipe 2*a*, and is bent downward at a rear end portion thereof. A frame 2*c* is connected to the rear end portion of the main frame 2*b*, and seat rails 2*d* extend rearward and slightly upward from a rear portion of the main frame 2*b*.

The integrated power unit 150 is suspended on the vehicle body frame so as to be disposed on the underside of the main frame 2*b* and on the inner side of the vehicle body frame in a position where the main frame 2*b* and the center frame 2*c* are bent.

A front wheel FW is rotatably supported by the lower ends of a front fork 4. The front fork 4 extends from the lower side of a steering shaft 3, which is skewly and rotatably supported on the head pipe 2*a*. A steering handle 5 spreads to the left and right sides from the upper end of the steering shaft 3.

Swing arms 6 are rotatably supported at their front ends on a pivot shaft P of the center frame 2*c*, and extend rearwards. In addition, a rear wheel RW is rotatably supported on rear end portions of the swing arms 6. A rear shock absorber 8 is interposed between a link mechanism 7, which is connected to the swing arm 6, and the vehicle body frame. A seat 9 is disposed on the seat rails 2*d*, the seat 9 configured to support a driver and passenger.

The integrated power unit 150 according to this embodiment, mounted on the motorcycle 1 as just-mentioned, includes a 4-cylinder water-cooled type internal combustion engine having four cylinders arranged in line, and is mounted on the motorcycle 1 in a transverse layout such that a crankshaft 10 of the power unit 150 is directed in the left-right direction of the vehicle.

The power unit 150 includes a crankcase 11 that is split to form an upper crankcase portion 11U and lower crankcase portion 11L. The confronting surfaces of the upper crankcase 11U and the lower crankcase 11L are respectively provided with semi-circular arc portions, and the crankshaft 10 is retained within the arc portions whereby the crankshaft 10 is rotatably supported between the upper 11U and lower 11L crankcases. The crankcase 11 includes a crank chamber 11C formed on a front half of the upper crankcase 11L, and a transmission chamber 11M is formed on the rear side of a crank chamber 11C. A cylinder block 12 is provided above the upper crankcase 11U. The cylinder block 12 has four integrally formed cylinders 12*c* arranged in line, and a cylinder head 13 is sequentially stacked on the cylinder block 12. The cylinder block 12 and cylinder head 13 are erected to incline slightly to the front side of the power unit 150. A cylinder head cover 14 provided on the cylinder head 13 provides a covering for the cylinder head 13. In addition, an oil pan 15 is attached under the lower crankcase 11L.

Figure 5:
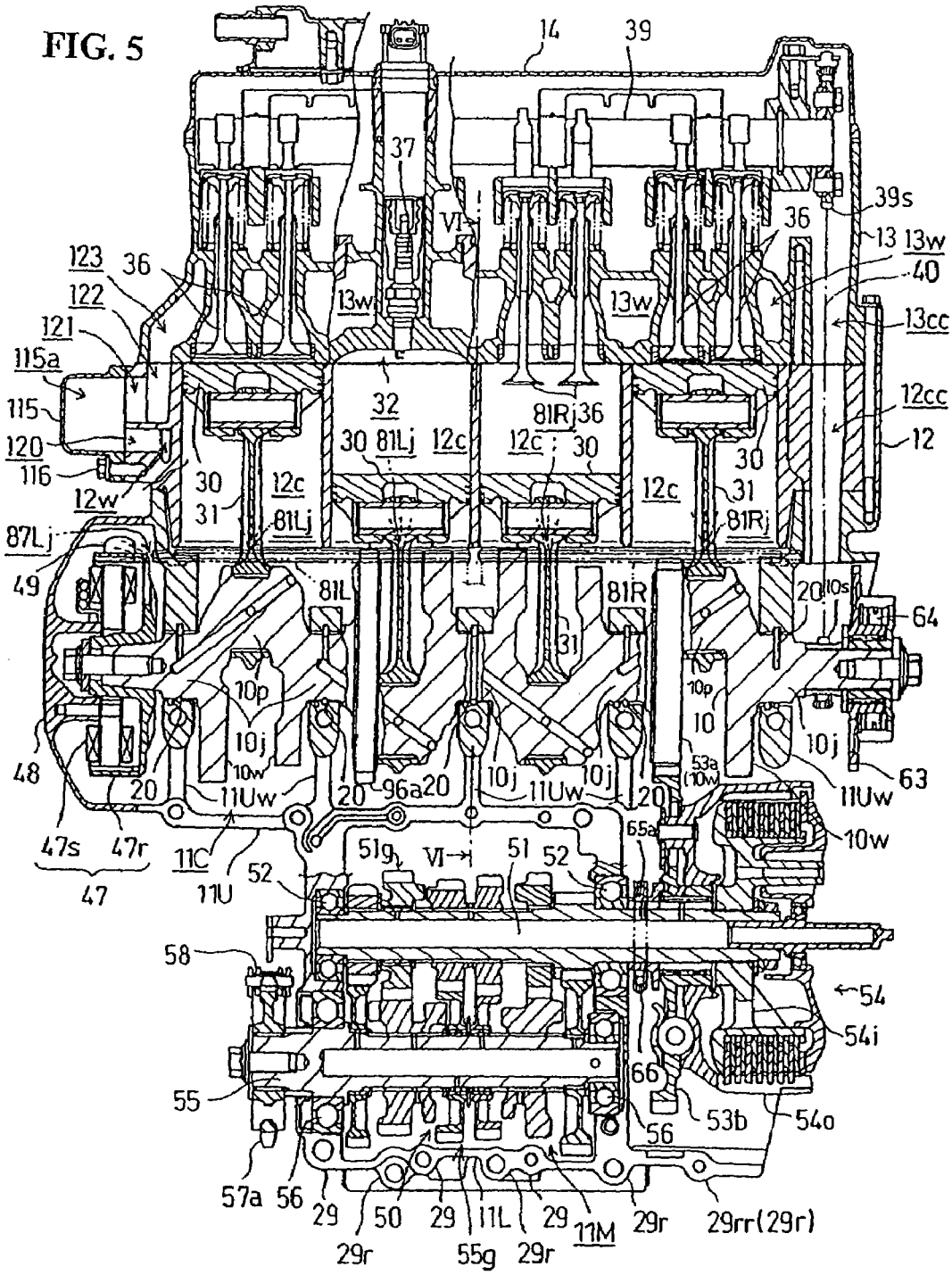
FIG. 5 is a sectional view of the integrated power unit of FIG. 1 taken along line V-V of FIG. 2.
Figure 6:
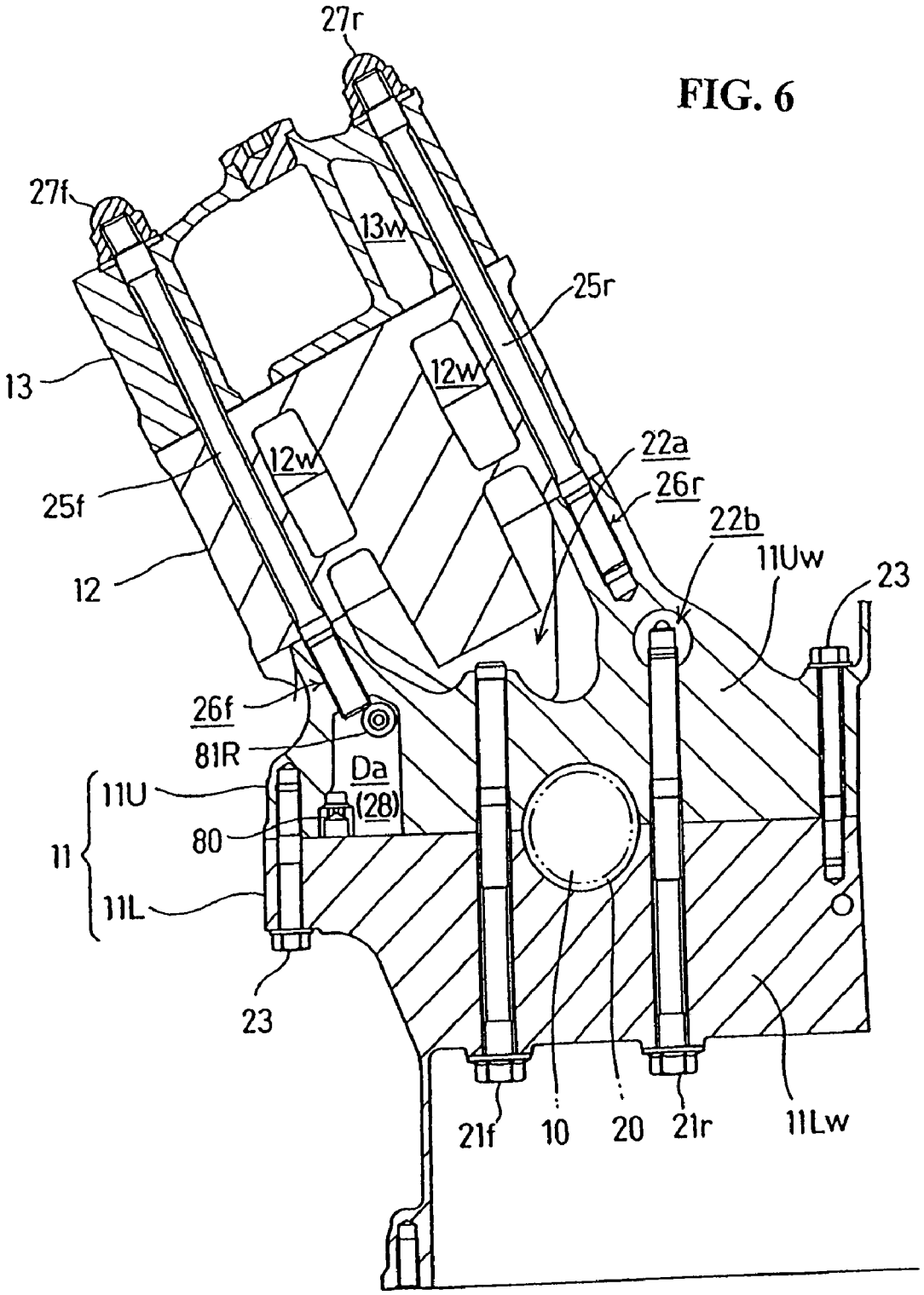
FIG. 6 is a schematic sectional view of a portion of the integrated power unit of FIG. 1 taken along line VI-VI of FIG. 5.

Referring to FIGS. 5 and 6, journal walls 11Uw and 11Lw of the upper crankcase 11U and the lower crankcase 11L support journal portions 10*j* of the crankshaft 10. In particular, the journal walls 11Uw and 11Lw retain the journal portions 10*j* therebetween through main bearings 20, thereby rotatably supporting the crankshaft 10. Since the integrated power unit 150, in the illustrative embodiment includes an in-line 4-cylinder engine, the crankshaft 10 has five journal portions 10*j*, and the crankshaft 10 is rotatably borne by the five upper and five lower journal walls 11Uw and 11Lw of the upper crankcase 11U and the lower crankcase 11L.

Figure 7:
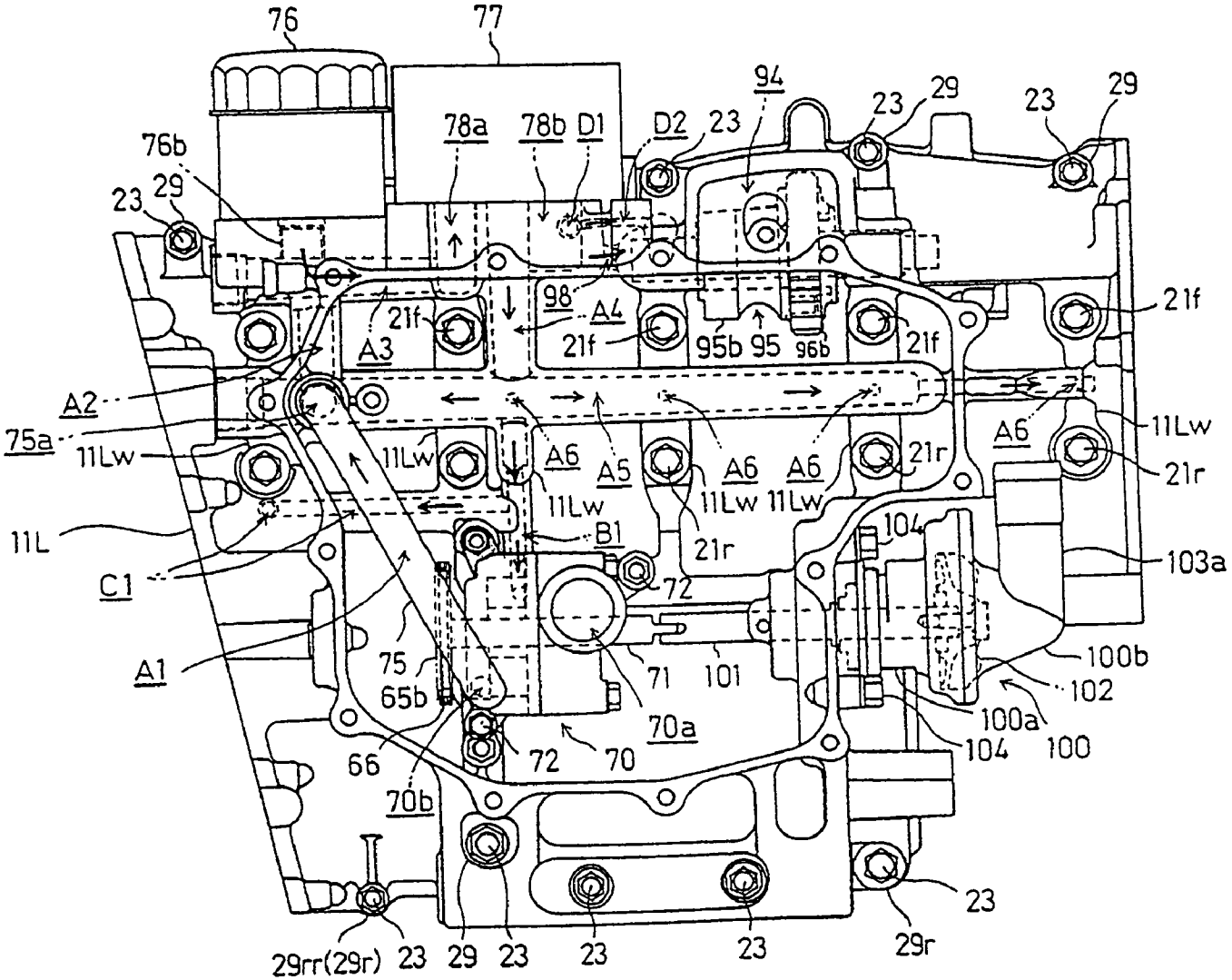
FIG. 7 is a bottom view of the crankcase of the integrated power unit of FIG. 1.

The upper crankcase 11U and the lower crankcase 11L are mated to each other along their respective confronting surfaces, and are integrally fastened to each other by bolts. Referring to FIG. 7, stud bolts 21*f* and 21*r* extend from the lower side of the crankcase, and extend straight upward to penetrate the lower crankcase 11L and are screwed and tightened into long screw holes bored in the upper crankcase 11U. In particular, stud bolts 21*f*, 21*r* are provided at each of the five upper and five lower journal walls 11Uw and 11Lw of the upper crankcase 11U and the lower crankcase 11L, and on the front and rear sides of the semi-circular arc portions which retain the crankshaft 10 therebetween.

When the stud bolt 21*f* on the front side is completely screwed into the screw hole in the upper crankcase 11U, the tip end of the stud bolt 21*f* projects into a cavity 22*a* of the crank chamber 11C. Similarly, after the stud bolt 21*r* on the rear side is completely screwed into the screw hole in the upper crankcase 11U, the tip end of the stud bolt 21*r* projects into a circular hole 22*b* bored in the upper crankcase 11U in parallel to the crankshaft 10. Therefore, the stress acting on the periphery of the screw holes due to screw engagement and tightening of the stud bolts 21*f* and 21*r* is restrained from being locally concentrated.

The upper crankcase 11U and the lower crankcase 11L are fastened not only by the stud bolts 21*f*, 21*r*, but also by a plurality of fastening bolts 23 provided at required portions of mainly a front end edge portion and a rear end edge portion of the crank case 11 (see FIGS. 6 and 7). As for the lower crankcase 11L, as shown in FIG. 7 showing a bottom view of the crankcase 11, the fastening bolts 23 are screwed to the fastening boss portions 29 of the front end edge portion and the rear end edge portion of the crank case 11.

Figure 2:
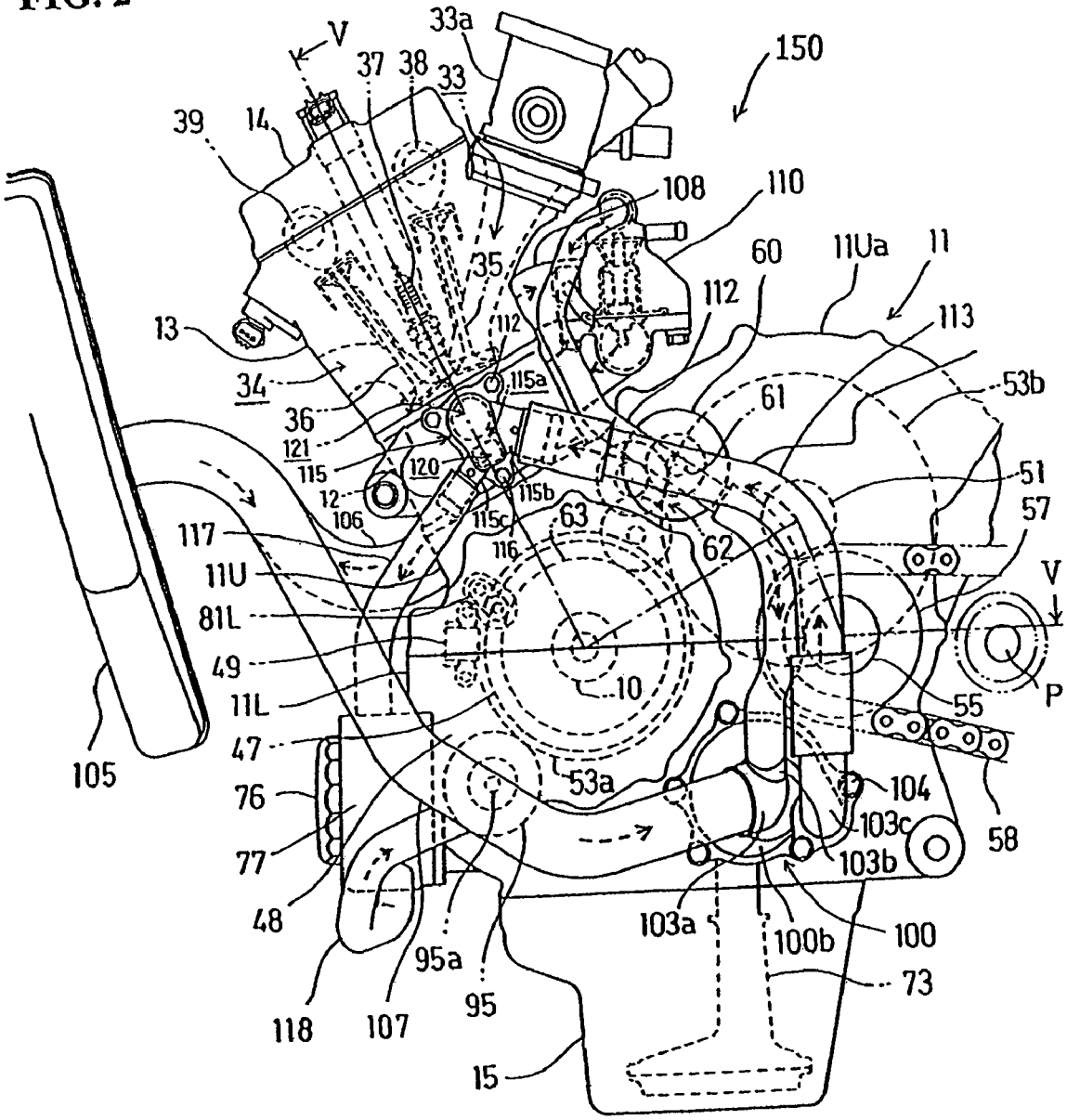
FIG. 2 is a left side view of the integrated power unit of FIG. 1.

FIG. 5 is a sectional view of the power unit 150 along line V-V in FIG. 2, and thus shows the upper (confronting) surface of a rear portion of the lower crankcase 11L, and further shows the fastening boss portions 29 located at the rear end edge portion of the lower crankcase 11L. The rearmost fastening boss portions 29*r* of the fastening boss portions 29 are disposed at the rearmost portion of the lower crankcase 11L, and are provided at four locations.

Of the four fastening boss portions 29*r* just mentioned, the fastening boss portion 29*rr* at the right end is located in the vicinity of a right rear corner portion of the lower crankcase 11L on the outside of the transmission chamber 11M, in which speed change gear groups 51*g* and 55*g* are contained. Moreover, when viewed in the plane corresponding to the confronting surfaces, the fastening boss portion 29*rr* is located behind (rearward of) a friction clutch 54 and a primary driven gear 53*b* as will be described later.

Figure 3:
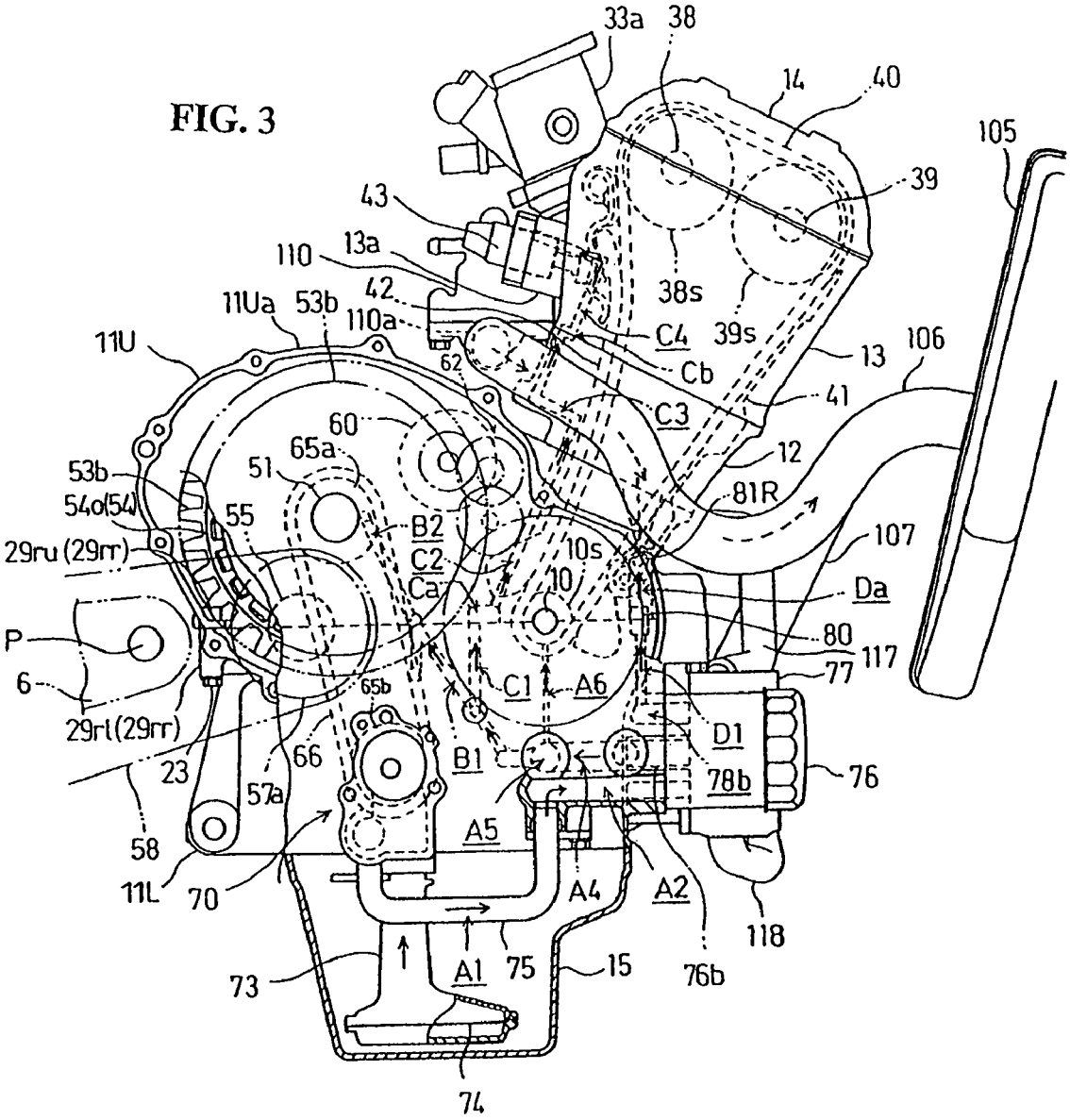
FIG. 3 is a partial right side view of the integrated power unit of FIG. 1.

FIG. 3 shows the crankcase 11 as viewed from the right side. In FIG. 3, it is seen that the fastening boss portion 29*rr* is disposed at a right rear corner portion of the lower crankcase 11L at the upper surface. The fastening boss portion 29*ru* (29*rr*) of the upper crankcase 11U is opposed to the fastening boss portion 29*rl* (29*rr*) of the lower crankcase 11L. Here, for each fastening boss portion 29*r*, the fastening boss portion 29*ru* and the fastening boss portion 29*rl* constitute an upper-lower pair mated to each other at the confronting surfaces, and are fastened by the fastening bolt 23 inserted into screw engagement therewith from the lower side.

The cylinder block 12 is stacked on the upper crankcase 11U in the state of being slightly inclined toward the front side of the power unit 150, with their respective mating surfaces mated to each other, and the cylinder head 13 is stacked on the cylinder block 12. The front and rear stud bolts 25*f* and 25*r* extend through, from the upper side, the portions of the cylinder head 13 and the cylinder block 12 continuous with the journal wall 11Uw of the upper crankcase 11U, and are screw-engaged with screw holes 26*f* and 26*r* bored in the upper crankcase 11U, whereby the cylinder head 13, the cylinder block 12 and the upper crankcase 11U are integrally fastened together.

During assembly, the lower ends of the stud bolts 25*f* and 25*r* are screw-engaged with the respective screw holes 26*f* and 26*r* bored in the mating surface of the upper crankcase 11U so as to plant the stud bolts 25*f* and 25*r* in an upwardly projecting state, then the cylinder block 12 is laid on the mating surface of the upper crankcase 11U so that the stud bolts 25*f* and 25*r* extend through through-holes bored in the cylinder block 12. Finally the cylinder head 13 is laid on the upper-side mating surface of the cylinder block 12 so that the stud bolts 25*f* and 25*r*, extending through the through-holes in the cylinder block 12 and projecting upwards, also extend through the through-holes bored in the cylinder head 13.

Thereafter, cap nuts 27*f* and 27*r* are placed in screw-engagement with upper-end male screw portions of the stud bolts 25*f* and 25*r* that extend upward through the through-holes in the cylinder head 13 and project upwards therefrom, and are tightened. As a result, the stud bolts 25*f* and 25*r*, attended by the cap nuts 27*f* and 27*r*, are screw-engaged further into the screw holes 26*f* and 26*r*, to integrally fasten the cylinder block 12 and the cylinder head 13 to the upper crankcase 11U.

The central three journal-walls 11Uw of the upper crankcase 11U are each provided with a cavity 28 opening at the confronting surface between the upper crankcase 11U and the lower crankcase 11L. In addition, the screw hole 26*f* on the front side of the upper crankcase 11U extends from the mating surface at which the upper crankcase 11U mates with the cylinder block 12, and opens into the cavity 28.

The stud bolt 25*f*, having penetrated the cylinder head 13 and the cylinder block 12, is screw-engaged with this screw hole 26*f*, and its tip end partly projects into the cavity 28. Therefore, the stress exerted on the periphery of the screw hole 26*f* in the upper crankcase 11U, due to the screw engagement and tightening of the stud bolt 25*f*, is restrained from being locally concentrated.

Pistons 30 are reciprocally and slidably fitted in cylinder bores 12*c* of the four cylinders in the cylinder block 12 thus integrally fastened to the upper crankcase 11U. Connecting rods 31 connect the pistons 30 to the crank pins 10*p*, the crankpins 10*p* being disposed between the crank webs 10*w*, 10*w* of the crankshaft 10.

In the cylinder head 13, and with respect to each cylinder bore 12*c*, a combustion chamber 32 is formed oppositely to the piston 30, intake ports 33 opening into the combustion chamber 32 and opened and closed with a pair of intake valves 35 are formed to extend rearward, exhaust ports 34 opened and closed with a pair of exhaust valves 36 are formed to extend forward, and a spark plug 37 fronting on the combustion chamber 32 is mounted. In addition, a throttle body 33*a* is connected to an intake passage pipe 33*b* on the upstream side of the intake ports 33, and an intake pipe (not shown) is connected to the upstream side thereof, whereas an exhaust pipe is connected to the openings on the downstream side of the exhaust ports 34.

An intake camshaft 38 and an exhaust camshaft 39 are rotatably supported in the cylinder head 13. Each intake valve 35 and each exhaust valve 36 are driven by the functions of the intake camshaft 38 and the exhaust camshaft 39 to open and close synchronously with the rotation of the crankshaft 10. For this purpose, cam sprockets 38*s* and 39*s* are fitted onto right end portions of the camshafts 38 and 39, and a timing chain 40 is wrapped around a drive sprocket 10*s*, fitted on a portion near a right end portion of the crankshaft 10, and the cam sprockets 38*s* and 39*s* (see FIGS. 3 and 5). The camshafts 38 and 39 are driven to rotate via the timing chain 40 and sprockets 38*s*, 39*s* at a rotating speed equal to one half that of the crankshaft 10.

The cylinder block 12 and the cylinder heads 13 are provided in their right end portions with cam chain chambers 12*cc* and 13*cc*, in which is disposed the timing chain 40 (see FIG. 5). In the cam chain chambers 12*cc* and 13*cc*, cam chain guides 41 and 42 are respectively provided along the front and rear sides of the timing chain 40. The cam chain guide 42, provided on the rear side of the cam chain chambers 12*cc*, 13*cc*, is urged by a hydraulic type cam chain tensioner 43 to press against the timing chain 40, thereby imparting an appropriate tension to the timing chain 40 (see FIG. 3). As shown in FIG. 3, the cam chain 43 is attached to a tensioner holder 13*a* projecting rearward from a rear wall of the cam chain chamber 13*cc* of the cylinder head 13.

On the other hand, referring again to FIG. 5, a left end portion of the crankshaft 10 projects leftward from the most left side journal walls 11Uw, 11Lw constituting a left side wall of the crankcase 11, and an outer rotor 47*r* of an AC generator 47 is fitted onto the left end portion of the crankshaft 10. An inner stator 47*s*, having a magneto coil of the AC generator 47, is supported on a generator cover 48 coveringly attached to the AC generator 47 from the left side, and is disposed inside the outer rotor 47*r*.

A pulser coil 49, which serves as an engine speed detector for detecting the rotational speed of the crankshaft 10, is disposed in the inside of the generator cover 48, in proximity to the front side of the outer periphery of the outer rotor 47*r* of the AC generator 47.

A transmission 50 is disposed in the transmission chamber 11M, which is formed in the crankcase on the rear side of the crank chamber 11C containing the crankshaft 10 therein. The transmission 50 is a normally meshed type gear mission, wherein at a position diagonally upward and rearward relative to the crankshaft 10, a main shaft 51 is rotatably supported on the upper crankcase 11U through a bearing 52. A counter shaft 55 is rotatably supported and retained between the confronting surfaces of the upper crankcase 11U and the lower crankcase 11L through a bearing 56 at a location on the rear side of the crankshaft 10. The speed change gear groups 51*g* and 55*g* are mounted respectively on the main shaft 51 and the counter shaft 55, which are parallel to the crankshaft 10. The speed change gear groups 51*g*, 55*g* have their paired gears meshed with each other, and are spline-fitted onto the respective shafts. In addition, a speed change is performed by a movement of the gear serving as a shifter by a speed change operating mechanism.

As shown in FIG. 5, a right end portion of the main shaft 51 protrudes rightward from the transmission chamber 11M, and a multiple disk type friction clutch 54 is provided at the right end portion of the main shaft 51. The friction clutch 54 includes the primary driven gear 53*b* formed as one body with a clutch outer member 54*o*. The primary driven gear 53*b* is meshed with the primary drive gear 53*a* formed at the second rightmost crank web 10*w* of the crankshaft 10, and the primary drive gear 53*a* and primary driven gear 53*b* together constitute a primary speed reduction mechanism. The outside diameter of the primary gear 53*a* is set so as to be larger than the outside diameter of the clutch outer member 54*o* of the friction clutch 54.

A clutch inner member 54*i*, which serves as an output side of the friction clutch 54, is spline-fitted onto the main shaft 51, so that the rotation of the crankshaft 10 is transmitted to the main shaft 51 through the primary speed reduction mechanism 53*a*, 53*b* and the friction clutch 54.

The rotation of the main shaft 51, in turn, is transmitted to the counter shaft 55 through the meshing of the speed change gear groups 51*g* and 55*g*.

The counter shaft 55 is also an output shaft. An output sprocket 57*a* is fitted onto a left end portion, penetrating the crankcase 11 leftward to protrude to the exterior, of the counter shaft 55, and a power transmission chain 58 is wrapped around the output sprocket 57*a* and a driven sprocket 57*b* on the rear wheel RW, to constitute a secondary speed reduction mechanism, through which power is transmitted to the rear wheel RW (see FIG. 1).

As shown in FIG. 5, a starting driven gear 63 is supported on the right end of the crankshaft 10 through a one-way clutch 64, and is disposed on the right side of a drive sprocket 10*s*.

Figure 4:
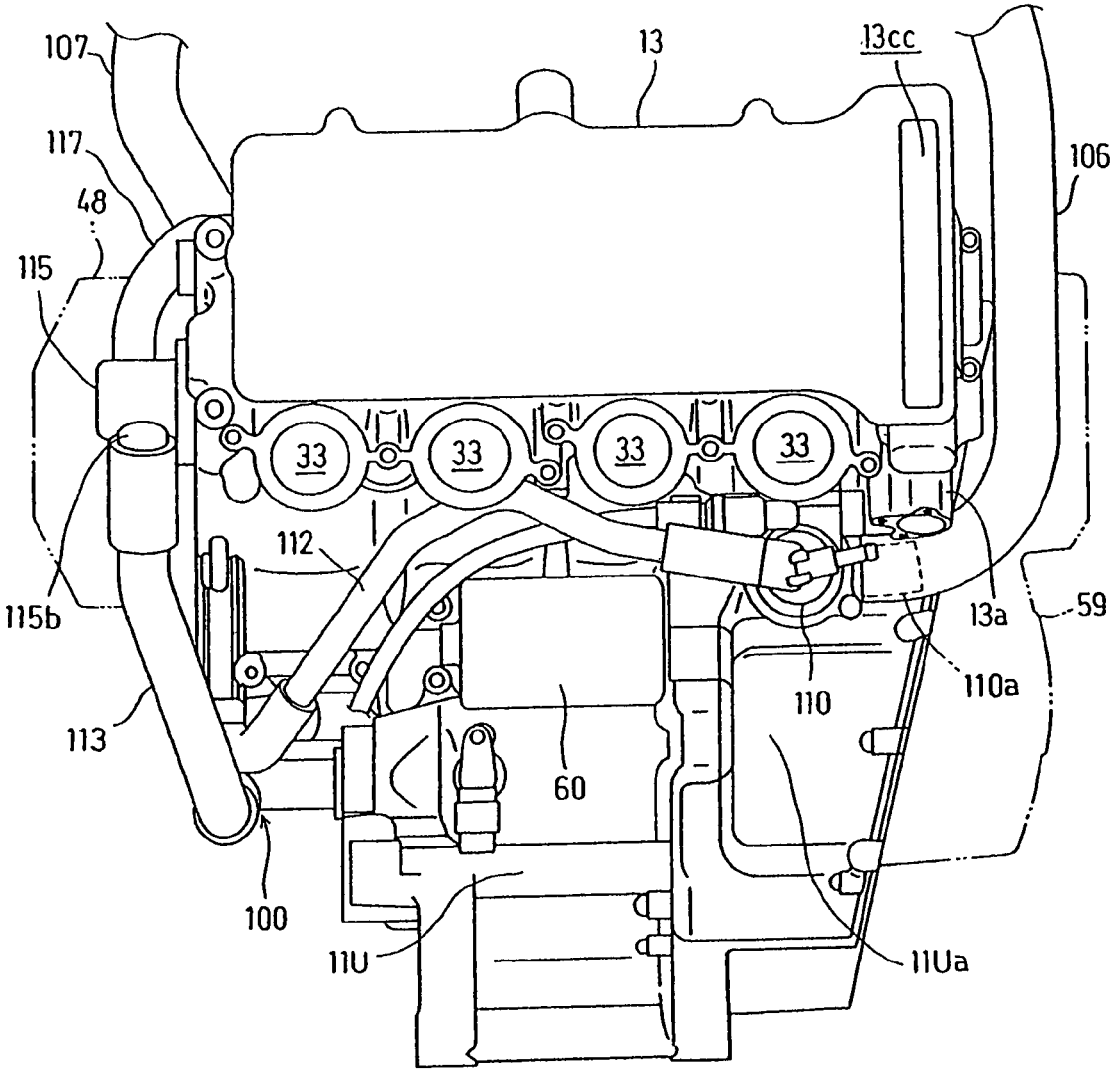
FIG. 4 is a partial plan view of the integrated power unit of FIG. 1.

A starter motor 60 for starting the internal combustion chamber E is attached to an upper surface of a rear-half portion of the crankcase 11 corresponding to the transmission chamber 11M of the crankcase 11, at a position slightly on the front side (see FIG. 2) of the transmission chamber M, and in the center of the transmission chamber M in the left-right direction of the upper surface (see FIG. 4).

An upper wall of a rear half portion of the crankcase 11 which forms the transmission chamber 11M on the rear side of a front half portion, connected with the cylinder block 12, of the upper crankcase 11U has a right side portion 11Ua that bulges largely toward the upper side so as to contain the friction clutch 54, the primary driven gear 53*b*, etc.. The starter motor 60 is attached along a left side surface of this bulged portion 11Ua. In addition, the right side of the friction clutch 54 and the like is covered with a clutch cover 59 (see FIG. 4).

A drive gear shaft 61 projects to the right side of the starter motor 60, and extends inwardly through a side wall of the bulged portion 11Ua of the upper crankcase 11U. A speed reduction gear mechanism 62 is interposed between the drive gear shaft 61 and the starting driven gear 63. Therefore, the rotation of the drive gear shaft 61 as driven by the starter motor 60 is transmitted to the starting driven gear 63 through speed reduction by the speed reduction gear mechanism 62, and the rotation of the starting driven gear 63 is transmitted through the one-way clutch 64 to the crankshaft 10, whereby the integrated power unit 150 is started.

As shown in FIG. 5, a drive sprocket 65*a* is rotatably borne on the main shaft 51 on the left side of and next to the primary driven gear 53*b*. The drive sprocket 65*a* has a projection fitted into a hole in the primary driven gear 53*b*, so as to be rotated as one body with the primary driven gear 53*b*.

Referring to FIG. 7, this figure shows a bottom view of the crankcase 11 as viewed from the lower side thereof. An oil pump 70 and a water pump 100 are attached side by side (on the left and right sides) to the lower crankcase 11L, below the main shaft 51.

The oil pump 70 is positioned on the right side of the lower crankcase 11L (in FIG. 7, shown on the left side of the figure), and is mounted to the inside of the lower crankcase 11L from the lower side by bolts 72. The water pump 100 is positioned on the left side of the lower crankcase 11L (in FIG. 7, shown on the right side of the figure) is fittedly mounted to a left side wall of the lower crankcase 11L from the outside using bolts 104. A drive shaft 71, projecting to the left side from the oil pump 70, and a drive shaft 101, projecting to the right side from the water pump 100, are coaxially connected to each other.

The drive shaft 71 of the oil pump 70 projects also to the right side, and a driven sprocket 65*b* is fitted onto a right end portion of the drive shaft 71. The drive sprocket 65*a*, provided on the main shaft 51, is located on the upper side of the driven sprocket 65*b*, and an endless chain 66 is wrapped around the drive sprocket 65*a* and the driven sprocket 65*b* (see FIG. 3).

Therefore, the rotation of the crankshaft 10 is transmitted from the drive sprocket 65*a*, integral with the primary driven gear 53*b* of the primary speed reduction mechanism, to the driven sprocket 65*b* through the endless chain 66. As a result, the drive shaft 71 of the oil pump 70 and the drive shaft 101 of the water pump 100 are driven to rotate together along with the driven sprocket 65*b*.

In addition, referring again to FIG. 7, a balancer chamber 94 is formed between a front portion of the central journal wall 11Uw, which corresponds to a central-side cylinder, and a front portion of the journal wall 11Uw on the left side thereof (in FIG. 7, on the right side thereof) and next thereto. A secondary balancer 95 is provided in the balancer chamber 94, and both ends of a balancer shaft 95*a* are supported by the left and right journal walls 11Uw, 11Uw. The secondary balancer 95 is located diagonally forward of and below the crankshaft 10 when viewed from the side (shown in FIG. 2). The secondary balancer 95 has a balance weight 95*b* supported on the balancer shaft 95*a* through a needle bearing 95*c*, and a balancer driven gear 96*b* is fitted onto the outer periphery of a boss portion of the balancer weight 95*b* (shown in FIG. 8).

The balancer driven gear 96*b* of the secondary balancer 95 is meshed with a balancer drive gear 96*a* (see FIG. 5), which is formed at a crank web of the crankshaft 10 and has twice the number of teeth as that of the balancer driven gear 96*b*. Therefore, the balance weight 95*b* of the secondary balancer 95 rotates at twice the rotational speed of the crankshaft 10, thereby absorbing secondary vibrations of the in-line four-cylinder internal combustion engine.

The oil pump 70 as an oil pressure source is a trochoidal pump, wherein an inner rotor integral with the drive shaft 71 rotates an outer rotor meshed with the periphery thereof, and the volume between the rotors is Varied, whereby an oil is drawn in and discharged.

A suction port 70*a* of the oil pump 70 opens to the lower side thereof(see FIG. 7), and a suction pipe 73 is connected to the suction port 70*a*. The suction pipe 73 extends downward inside the oil pan 15, and is fitted with an oil strainer 74. A lower end portion of the suction pipe 73 is located close to a bottom surface of the oil pan 15 (see FIG. 3). Therefore, when the oil pump 70 is driven, the oil collecting in the oil pan 15 is pumped up by being drawn through the oil strainer 74 into the suction pipe 73.

A discharge port 70*b* of the oil pump 70 also opens to the lower side, and, as shown in FIGS. 3 and 7, one end of an oil supply pipe 75 forming a first oil supply passage A1 is connected to the discharge port 70*b*. The oil supply pipe 75 extends diagonally outward and frontward toward the front right side of the crankcase 11 (in FIG. 7, left side) while turning round about to the lower side in the oil pan 15, and the other end thereof is connected to an inlet 75*a* opening on the lower side of an end portion of a second oil supply passage A2. Oil supply passage A2 is a bore which extends rearward from an inflow port 76*a* (see FIG. 8) of an oil filter 76. The oil filter 76 is provided so as to project outward from a front surface of the crankcase 11 in the vicinity of the right end of a front surface of the lower crankcase 11L.

Figure 8:
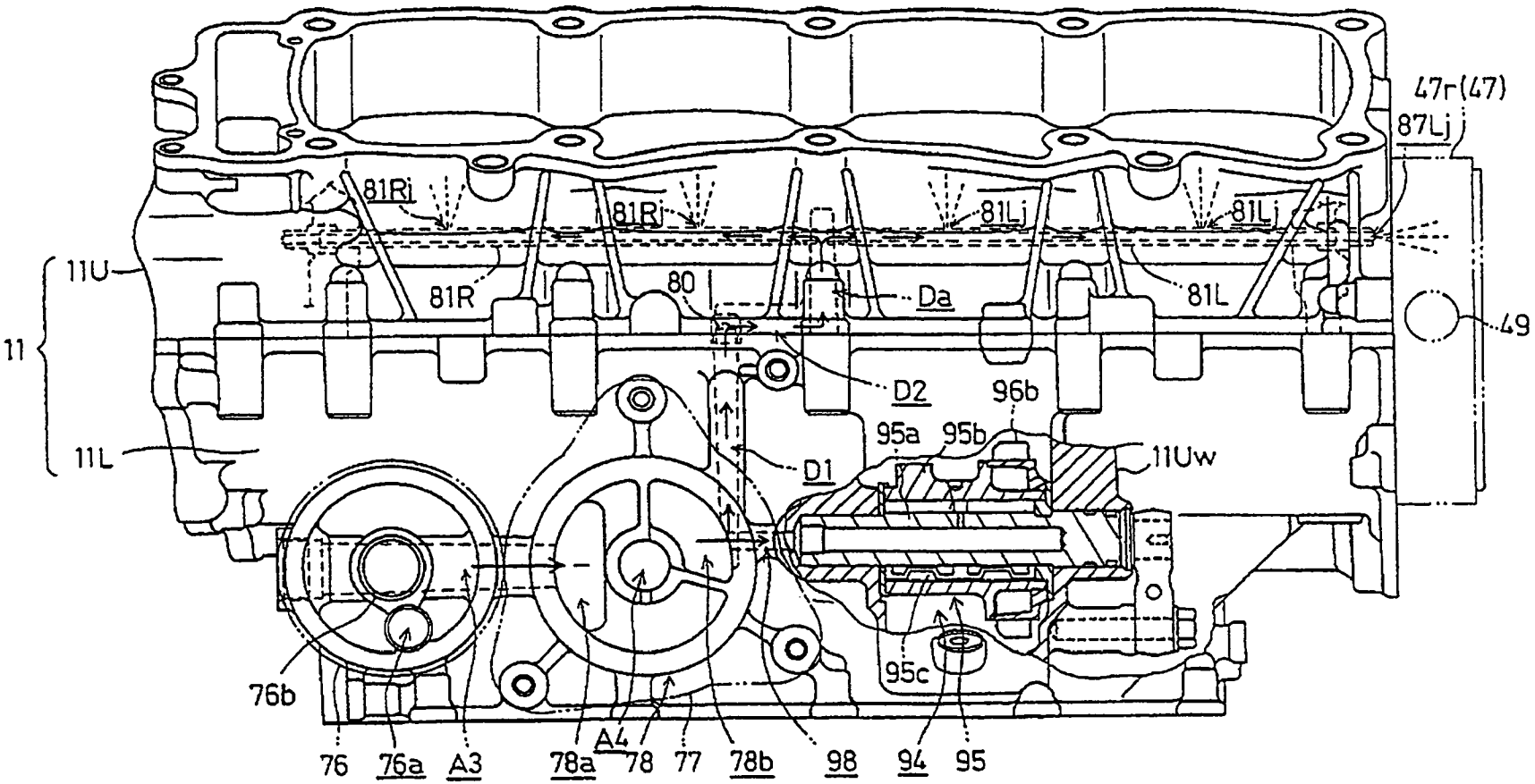
FIG. 8 is a front view of the crankcase of the integrated power unit of FIG. 1.

Referring to FIGS. 7 and 8, at the front surface of the lower crankcase 11L, an oil cooler 77 is provided so as to project outward from a front surface of the crankcase 11 just on the left side (on the right side, in FIGS. 7 and 8) of the oil filter 76, which is disposed in the vicinity of the right end of the front surface. An oil cooler housing 78, which constitutes an inflow port 78*a* and an outflow port 78*b* of the oil cooler 77, is formed at a portion, fitted with the oil cooler 77, of the front surface of the lower crankcase 11L. The above-mentioned balancer 95 is disposed on the left side of, and next to, the oil cooler housing 78 (see FIG. 7).

As shown in FIG. 7, an outflow tube 76*b* projects from the rear side of the oil filter 76, and communicates with a third oil supply passage A3. The third oil supply passage A3 is a bore which extends along the left-right direction of the crankcase, and the third oil supply passage A3 communicates with the inflow port 78*a* of the oil cooler housing 78. A fourth oil supply passage A4 is a bore which extends rearward from the outflow port 78*b* at a central portion of the oil cooler housing 78 (see FIGS. 7 and 8).

A main gallery A5 provides a fifth oil supply passage, and comprises a bore which extends on the lower side of the crankshaft 10 in parallel to the crankshaft 10, so as to orthogonally intersect the fourth oil supply passage A4. The main gallery A5 extends through the five journal walls 11Lw of the lower crankcase, 11L, and, in each of the journal walls 11Lw, an oil branch supply passage A6 is provided. Each oil branch supply passage A6 is a bore which extends toward each journal bearing portion.

In addition, referring to FIG. 3, an oil supply passage B1 is provided which supplies oil diagonally upward to the side of the transmission 50 on the rear side of the oil supply passage A4. The oil supply passage B1 is a bore which extends from a rear end portion of the oil supply passage A4, and, in connection with the oil supply passage B1, an oil supply passage B2 for supplying the oil to the bearing portion of the main shaft 51 is bored in the upper crankcase 11U.

In addition, referring to FIGS. 3 and 7, in the lower crankcase 11L, a first oil supply passage C1 for supplying the oil to the cam chain tensioner 43 is a bore which branches rightward from an intermediate portion of the oil supply passage B1. The first oil supply passage C1 extends to the rightmost journal wall 11Lw, bends upwards from a right end portion of the rightmost journal wall 11Lw, and opens to the respective surfaces at which the upper 11U and lower 11L crankcase portions are joined.

Opposite to the opening of the first oil supply passage C1 to the confronting surface, a recess with an appropriate volume is formed in the lower (confronting) surface of the rightmost journal wall 11Uw of the upper crankcase 11U. The opening of the recess, exclusive of the portion corresponding to the opening of the first oil supply passage C1, is closed by means of the confronting surface of the journal wall 11Lw of the lower crankcase 11L so that the recess constitutes an oil sump chamber Ca.

In the upper crankcase 11U, a second oil supply passage C2 is a bore that extends at a slant upward from the oil sump chamber Ca, which is formed along the confronting surface of the journal wall 11Uw, toward the mating surface at which the upper crankcase 11U mates with the cylinder block 12. The second oil supply passage C2 is connected to a third oil supply passage C3. The third oil supply passage C3 is a bore which extends in a rear portion of the right side wall of the cylinder block 12.

In the cylinder block 12, the third oil supply passage C3 extends in the cylinder axis direction from the mating surface at which the upper crankcase 11U mates with the cylinder block 12, then the third oil supply passage C3 is bent toward the rear side, is again bent to extend toward the mating surface at which the cylinder block 12 mates with the cylinder head 13, and extends through a labyrinth structure portion Cb formed at the mating surface, to communicate with a fourth oil supply passage C4 bored in the cylinder head 13.

The fourth oil supply passage C4 is bent in an L shape, and is connected to an inflow port of the cam chain tensioner 43, whereby the fourth oil supply passage C4 supplies oil to the cam chain tensioner 43. The labyrinth structure portion Cb in this course has a labyrinth formed at the mating surface between the cylinder block 12 and the cylinder head 13 so as to extend back and forth between the two members, and functions as a filter.

On the other hand, referring to FIGS. 3 and 8, a first oil supply passage D1 for supplying the oil for cooling the pistons is a bore which extends vertically upward from the outflow port 78*b* of the oil cooler housing 78, which is located in the lower crankcase 11L, to an upper side of the confronting surface at which the upper 11U and lower 11L crankcase portions are joined. A communicating hole 98 is formed to extend from the outflow port 78*b* of the oil cooler housing 78 toward the balancer shaft 95*a* of the balancer 95, so as to supply the oil for lubrication of the balancer 95 (see FIGS. 7 and 8).

As described above, a cavity 28 is formed in the central journal wall 11Uw, of the five journal walls 11Uw of the upper crankcase 11U. The cavity 28 opens to the case confronting surface at which the upper 11U and lower 11L crankcase portions are joined. A groove is formed in the confronting surface of the upper crankcase 11U, the groove constituting a second oil supply passage D2 that extends between the opening of the central cavity 28 and the first oil supply passage D1.

Specifically, the second oil supply passage D2 is configured so that a part of the opening of the groove formed in the upper crankcase 11U is covered with the confronting surface of the lower crankcase 11L.

A filter 80 is interposed at the connection portion where an upper end portion of the first oil supply passage D1 is connected with the second oil supply passage D2 in the confronting surface. The filter 80 is formed having a plurality of minute hole portions.

The cavity 28 formed in the central journal wall 11Uw of the upper crankcase 11U, with which the second oil supply passage D2 communicates, is covered from below with the confronting surface of the lower crankcase 11L so as to form an oil sump chamber Da, which is a third oil supply passage and has an appropriate volume so as to be capable of temporarily reserving the oil.

Figure 9:
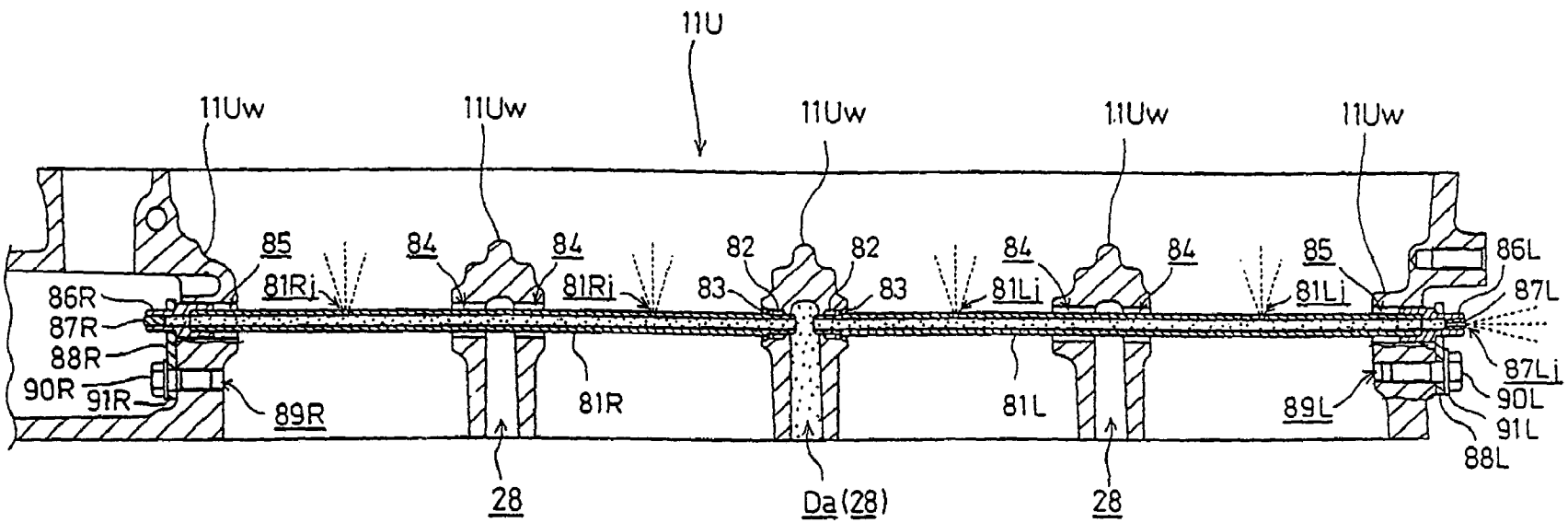
FIG. 9 is a sectional view of an upper crankcase of the integrated power unit of FIG. 1.

Referring to FIG. 9, left and right piston-cooling oil jetting pipes 81L and 81R are composed of straight tubular members, and are disposed in an upper space of the upper crankcase portion 11U. Inner end portions of the left and right piston-cooling oil jetting pipes 81L and 81R are fitted to the left and right sides of the oil sump chamber Da, whereby the piston-cooling oil jetting pipes 81L and 81R extend outwards on the left and right sides (on the right and left sides, in FIG. 9) from the oil sump chamber Da.

Each of the left and right oil jetting pipes 81L and 81R are provided with two oil jetting oils such that the left oil jetting pipe 81L includes two left oil jets 81Lj, and the right oil jetting pipe 81R includes two right oiljets 81Rj. The oil jets 81Lj, 81Rj are oil jetting holes directed toward the cylinder bores 12*c* on the upper side, and are disposed at middle positions between the adjacent ones of the five journal walls 11Uw.

The left and right side walls forming the oil sump chamber Da are provided with circular holes coaxially at predetermined positions. Inner end portions of the left and right oil jetting pipes 81L and 81R are fitted into the circular holes through collars 82, 82 and O-rings 83, 83 so that the inner end portions confronting the oil sump chamber Da serve as oil inlet ports of the left and right oil jetting pipes 81L, 81R.

Intermediate portions of the left and right oil jetting pipes 81L and 81R extend through circular holes 84, 84 formed in the journal walls 11Uw, 11Uw on the left and right sides of, and next to, the central journal wall 11Uw. In addition, outer end portions of the oil jetting pipes 81L and 81R are inserted into circular holes 85, 85 formed in the leftmost and rightmost journal walls 11Uw, 11Uw.

Tubular end members 86L and 86R are fitted over the outer end portions of the left and right oil jetting pipes 81L and 81R.

The end members 86L and 86R are of uniform wall thickness and of non-uniform diameter in the axial direction. That is, the end members 86L, 86R are each provided with a large diameter end opposed to a small diameter end. The end members 86L and 86R are fitted over the outer end portions of the left and right oil jetting pipes 81 L and 81 R in such a manner that the oil jetting pipes 8L and 8R are press fitted into the large diameter ends. To achieve the press fit, the large diameter end of the end members 86L, 86R are provided inside diameter portions having an inside diameter equal to the outside diameter of the oil jetting pipes 81L and 81R.

In addition, the large diameter ends of the end members 86L and 86R are press fitted into the circular holes 85, 85 formed in the leftmost and rightmost journal walls 11Uw, 11Uw, and outer end portions of the oil jetting pipes 81L and 81R are attached to and supported by the leftmost and rightmost journal walls 11Uw, 11Uw through the end members 86L, 86R. As seen in FIG. 9, parts of the large diameter ends and the small diameter ends of the end members 86L, 86R protrude to the exterior of the crankcase 11.

A cylindrical oil jet member 87L provided with an oil jet 87Lj as an oil jetting hole is press fitted into the outside opening of the small diameter end of the left-side end member 86L. On the other hand, a plug member 87R is press fitted into the outside opening of the small inside diameter portion of the right-side end member 86R, whereby the opening on the right side of the right oil jetting pipe is closed.

Plate-like attaching stays 88L, 88R are used to secure the end members 86L, 86R to the crankcase 11. Circular holes are provided in tip end portions of the attaching stays 88L, 88R, and are press fitted over the outwardly protruding small diameter ends of the end members 86L, 86R.

In addition, circular holes 88La, 88Ra are provided in base end portions of the attaching stays 88L, 88R, which are aligned with screw holes 89L, 89R formed at predetermined positions of the leftmost and rightmost journal walls 11Uw, 11Uw. The attaching stays 88L, 88R are fastened to the outside surface of the crankcase 11 using fastening bolts 90L, 90R extending through washers 91L, 91R.

The left and right oil jetting pipes 81L, 81R mounted so as to extend through the five journal walls 11Uw of the upper crankcase 11U, and to have the oil jets 81Lj, 81Rj face the pistons 30 in the corresponding cylinder bores 12*c*, whereby oil can be effectively jetted to the pistons 30, thereby effectively cooling the pistons 30.

In addition, the oil jet member 87L is press fitted into the left end of the left-side oil jetting pipe 81L, whereby oil is jetted leftward from the oil jet 87Lj in the oil jet member 87L. The oil jet 87Lj jets the oil not directly to the AC generator 47, but rather to the annular space between the outer peripheral surface of the outer rotor 47*r* of the AC generator 47 and the inner peripheral surface of the generator cover 48, whereby the AC generator 47 is cooled.

Referring to FIG. 2, the water-cooled type integrated power unit 150 has a cooling system in which the water pump 100 is driven to rotate in conjunction with the oil water pump 70, through the connection of the drive shaft 71 and the drive shaft 101 to each other, and is used as a cooling water supply source. In the cooling system for the integrated power unit 150, the water pump 100 is attached to a rear portion of the left side wall of the lower crankcase 11L as described above. In addition, a radiator 105 is disposed on the front side of the integrated power unit 150, and a thermostat case 110 is connected to a cooling water discharge pipe 108. The cooling water discharge pipe constitutes a cooling water outlet that extends rearward from the lower side of the intake port 33 of the right end cylinder in the cylinder head 13. A wax type bottom bypass thermostat is incorporated in the thermostat case 110.

In the water pump 100, a pump chamber is composed of a pump body 100*a* bearing the drive shaft 101 and a pump cover 100*b* (see FIG. 7). The pump chamber contains an impeller 102 which rotates as one body with the drive shaft 101. A radiator outflow hose 107 is connected at its one end to a connecting pipe 103*a* extended to the front side of a suction port of the pump cover 10b, and is disposed along a lower portion of the left side surface of the lower crankcase 11L. The other end of the radiator outflow hose 107 is connected-to an outflow port of a radiator 105.

In addition, a bypass hose 112 is connected at its one end to a connecting pipe 103*b* extending to the upper side of the suction port of the pump cover 100*b*. The bypass hose 112 extends upward along rear portions of left side surfaces of the rear half portions, forming the transmission chamber 11M, of the lower crankcase 11L and the upper crankcase 11U, and is diagonally bent to the front right side on the upper side of the rear half portion of the upper crankcase 11U. The bypass hose 112 then passes on the left side of the starter motor 60, extends diagonally toward the right upper side between the starter motor 60 and the cylinder block 12 and the cylinder head 13 in the top plan view of FIG. 4, and is connected at its other end to an upper portion of the thermostat case 110.

In addition, a pump discharge hose 113 serves as a cooling water supply pipe, is connected at one end to a connecting pipe 103*c* which extends from a discharge port of the pump cover 100*b* of the water pump 100, and extends upward along rear portions of the left side surfaces of the lower crankcase 11L and the upper crankcase 11U. The pump discharge hose 113 is bent toward the front side of the crankcase 11, and is connected at its other end to an inflow connecting pipe 115*b*. The inflow connecting pipe 115*b* extends toward the diagonal rear side of a pipe joint member 115 that is provided so as to project from the left side surface of the cylinder block 12.

The pipe joint member 115 has an inner space 115 formed to open in a vertically elongate shape in the mating surface at which the cylinder head 13 is mated with the cylinder block 12. A flange portion at an end edge of the opening is fastened to the cylinder block 12 by bolts 116 used at three locations (see FIGS. 2 and 5).

As shown in FIG. 5, the left side wall of the cylinder block 12 is provided with a lower cooling water inlet 120 and an upper cooling water inlet 121 partitioned to the upper and lower sides and opposed to the opening of the inner space 115*a* of the pipe joint member 115. The lower cooling water inlet 120 communicates with a first water jacket 12*w* formed around the cylinder bore 12*c* in the cylinder block 12, whereas the upper cooling water inlet 121 has an upwardly bent communicating hole 122 connected to a communicating hole 123 in the cylinder head 13, and the communicating hole 123 communicates with a second water jacket 13*w* in the cylinder head 13.

In addition, as shown in FIG. 2, the pipe joint member 115 has a branch connecting pipe 115*c* that extends diagonally to the front side. An oil cooler inflow hose 117 is connected at one end to the branch connecting pipe 115*c*, and extends diagonally toward the front lower side. The oil cooler inflow hose 117 is connected at its other end to a water inflow port of the oil cooler 77 that is provided so as to project from a front surface of the lower crankcase 11U.

An outflow hose 118 extends from a water outflow port of the oil cooler 77, and is connected to the radiator outflow hose 107. Cooling water, having passed through the oil cooler 77, is returned into the water pump 100 by utilizing a part of the radiator outflow hose 107.

The cooling system for the integrated power unit 150 is configured as described above. The cooling water discharged by the driving of the water pump 100 flows through the pump discharge hose 113 to the pipe joint member 115 in the cylinder block 12, and is branched into the lower cooling water inlet 120 and the upper cooling water inlet 121 at the left side wall of the cylinder block 12. The portion of the cooling water that has entered the lower cooling water inlet 120 flows rightward through the first water jacket 12*w* in the cylinder block 12, to cool the cylinder block 12. The portion of the cooling water that has entered the upper cooling water inlet 121 flows through the communicating holes 122 and 123, and flows rightward through the second water jacket 13*w* in the cylinder head 13, to cool the cylinder head 13.

A gasket clamped between the mating surfaces of the cylinder block 12 and the cylinder head 13 partitions the first water jacket 12*w* in the cylinder block 12 and the second water jacket 13*w* in the cylinder head 13 from each other, but a communication hole is bored in a part of the right end of the gasket, and cooling water having cooled the cylinder block 12 flows from the first water jacket 12*w* into the second water jacket 13*w*. Therefore, the cooling water having independently flowed through the first water jacket 12*w* and the cooling water having independently flowed through the second water jacket 13*w* are mixed with each other, and, at a right end portion of the rear surface of the cylinder head 13, the mixed cooling water flows out through a cooling water discharge pipe 108 extended rearwards, to reach the thermostat case 110.

The flow of cooling water to the radiator 105 is both permitted and interrupted under the control of the thermostat 110 according to the warmed-up condition of the integrated power unit 150.

On the other hand, the cooling water discharged from the water pump 100 into the pump discharge hose 113 flows through the pipe joint member 115 and branches into the lower cooling water inlet 120 and the upper cooling water inlet 121 in the cylinder block 12. In addition, the cooling water also flows through the inner space 115*a* of the pipe joint member 115 and branches into the inflow hose 117 to reach the oil cooler 77, and flows from the oil cooler 77 through the outflow hose 118 and through a part of the radiator outflow port 107, to return to the water pump 100 in the manner of circulation, thereby cooling the oil.

The integrated power unit 150 is configured generally as above-described. The crankcase 11 for forming the crank chamber 11C and the transmission chamber 11M is split into the upper and lower sides, and, as described above, the upper crankcase 11U and the lower crankcase 11L are mated with each other at their respective confronting surfaces and are fastened together by the stud bolts 21*f*, 21*r* and the plurality of fastening bolts 23.

Referring now to FIG. 3, which shows the crankcase 11 as viewed from the right side, the right end fastening boss portion 29*rr* is located so as to overlap with a rear portion of the friction clutch 54 in the vehicle front-rear direction. The right end fastening boss portion 29*rr* is representative of the four rearmost fastening boss portions 29*r* disposed at the rearmost portions of the rear end edge portion of the lower crankcase 11L. In each of the rearmost fastening boss portions 29*r*, the fastening boss portion 29*ru* formed on the upper crankcase 11U, and the fastening boss portion 29*rl* formed on the lower crankcase portion 11L, constitute an upper-lower pair mated to each other at the respective confronting surfaces.

The main shaft 51 is located at a position that is somewhat above and in front of the counter shaft 55, and the countershaft 55 is supported by and retained between the confronting surfaces of the upper crankcase 11U and the lower crankcase 11L at a location on the rear side of the crankshaft 10. A rear portion of the large-diameter friction clutch 54, which is provided at the right end of the main shaft 51, is located above the fastening boss portions 29*ru*, 29*rl*.

Since the rearmost fastening boss portions 29*r* are located on crankcase at a location which is sufficiently forward so as to overlap with the rear portion of the friction clutch 54 in the vehicle front-rear direction, the vehicle body on the rear side relative to the integrated power unit 150 may be designed more compactly.

The counter shaft 55 is the output shaft, and the left end portion of the countershaft 55 extends leftward through the crankcase 11 and protrudes to the exterior thereof. The output sprocket 57*a* is fitted onto the left end portion of the counter shaft 55, and a power transmission chain 58, which transmits power to the rear wheel RW, is wrapped around the output sprocket 57*a*.

The pivot shaft P, which supports the front ends of the swing arms 6, is located on the rear side of the fastening boss portion 29*rr* (29*r*) at the rear end portion of the confronting surfaces of the crankcase 11, and underlies a portion of the upper crankcase 11U, as shown in FIG. 3.

Referring now to FIGS. 1 and 3, the fastening boss portions 29*r*, disposed at the rearmost portion of the crankcase 11, are located sufficiently forward to such an extent as to overlap with the rear portion of the friction clutch 54 in the vehicle front-rear direction. As a result, the pivot shaft P is positioned close to the output sprocket 57*a*. Specifically, the pivot shaft P is positioned closer to the output sprocket 57*a* than is possible in a conventional engine design. Therefore, the pivot axis of the swing arms 6 is located closer to the power transmission chain 58 than is possible in a conventional engine design, so that the power transmission chain 58 is stabilized in tension and reduced in friction.

In addition, by providing a configuration in which the pivot axis of the pivot shaft P, located at the front ends of the swing arms 6, is located more forwardly on the vehicle and as close to the integrated power unit 150 as possible, sufficient swing arm length from the pivot axis to the rear wheel axle is secured without enlarging the wheel base, and enhanced movement performance of the vehicle is obtained.

Thus, the right end fastening boss portion 29*rr* of the rearmost fastening boss portions 29*r* of the confronting surfaces of the crankcase 11 is located below the rear portion of the friction clutch 54 (see FIGS. 3 and 5). The position of the fastening boss portion 29*rr* in the left-right direction (that is, the axial direction of the crankshaft) coincides with the position of the right-end crank pin 10*p* of the crankshaft 10 borne by the confronting surfaces of the crankcase 11, in the axial direction of the crankshaft, as shown in FIG. 5.

Since the fastening boss portions 29*rl*, 29*ru* are located as close as possible to the clutch outer 54*o* of the friction clutch 54 on the front side, the teeth portion (the maximum diameter circle of the primary driven gear 53*b* indicated by two-dotted chain line in FIG. 3) at the outer periphery of the large-diameter primary driven gear 53*b*, abutting on and fixed to the left side surface of the clutch outer 54*o*, overlaps with the rearmost fastening boss portions 29*r* in side view, and is located on the left side (the depth side in right side view in FIG. 3) relative to the right end fastening boss portion 29*rr* (FIG. 5).

The friction clutch 54, having the primary driven gear 53*b*, is mounted to a right end portion of the main shaft 51 from the right side. Therefore, when the primary driven gear 53*b* is to be mounted coaxially with the main shaft 51, the primary driven gear 53*b* cannot be mounted to the left side (depth side) of the right end fastening boss portion 29*rr* due to the interference of the right end fastening boss portion 29*rr*.

However, since the right end fastening boss portion 29*rr* is at the same position as the crank pin 10*p* at the right end of the crankshaft 10, in the crankshaft direction, the friction clutch 54 can be mounted onto the main shaft 51 by a method in which the primary driven gear 53*b* is mounted to the left side (depth side) of the right end fastening boss portion 29*rr*. This is achieved by riding over the right end fastening boss portion 29*rr* while once releasing the primary driven gear 53*b* to the space between a pair of crank webs 10*w*, 10*w* where the crank pin 10*p* of the crankshaft 10 is provided. As a result, mountability of the friction clutch is maintained.

In addition, since the fastening boss portions 29*rl*, 29*ru* are located in the vicinity of the right rear corner portion of the confronting surfaces of the crankcase 11, the fastening of the upper crankcase 11U and the lower crankcase 11L can be performed at a position near the corner portion, whereby the fastening force for the upper crankcase 11U and the lower crankcase 1lL can be enhanced.

While a working example of the present invention has been described above, the present invention is not limited to the working example described above, but various design alterations may be carried out without departing from the present invention as set forth in the claims.

What is claimed is:

1. An integrated power unit for a small vehicle, the power unit comprising:

a crankshaft;

a transmission shaft;

a crankcase, the crankcase being split into an upper crankcase and a lower crankcase;

a crank chamber formed within the crankcase, the crankshaft rotatably supported within the crank chamber and having an axis which is oriented in a transverse direction which is orthogonal to a forward travel direction of the vehicle;

a transmission chamber within the crankcase on a rear side of the crank chamber, the transmission shaft rotatably supported within the transmission chamber; and a clutch which permits connection and disconnection of power of the crankshaft to and from the transmission shaft, the clutch disposed at one end of the transmission shaft, wherein respective confronting surfaces of the upper crankcase and the lower crankcase are provided with a plurality of fastening boss portions arranged as vertically opposed pairs, the upper crankcase and the lower crankcase are fastened together by fastening the respective vertically opposed pairs of the fastening boss portions using fastening bolts so as to integrate the upper crankcase and the lower crankcase into a single entity, wherein rearmost ones of the plurality of fastening boss portions are located so as to be vertically overlapping with a rear portion of the clutch, and wherein the rearmost fastening boss portions are set at a position near a rear corner portion of the crankcase.

2. The integrated power unit for a small vehicle as set forth in claim 1, wherein the crankshaft is rotatably supported between the respective confronting surfaces of the upper crankcase and the lower crankcase, the crankshaft comprising at least one crankpin connecting at least one pair of crank webs; and wherein the crankshaft has a drive gear provided thereon, and wherein the clutch further comprises:

a driven gear, the driven gear meshed with the drive gear provided on the crankshaft; and a clutch mechanism;

wherein an outside diameter of the driven gear is greater than an outside diameter of the clutch mechanism; and wherein one of the rearmost fastening boss portions is substantially aligned, along said transverse direction, with said at least one crank pin.

3. The integrated power unit for the small vehicle as set forth in claim 2, wherein the crankshaft comprises four pairs of crank webs, and wherein the one of the rearmost fastening boss portions is disposed adjacent to a transverse side of the crankcase corresponding to the one end of the transmission shaft.

4. The integrated power unit for the small vehicle as set forth in claim 1, wherein the power unit further comprises a drive gear provided on the crankshaft, and wherein the clutch comprises:

a driven gear, the driven gear meshed with the drive gear provided on the crankshaft; and a clutch mechanism, wherein the outside diameter of the driven gear is greater than the outside diameter of the clutch mechanism; and one of the rearmost fastening boss portions, provided at an end of the crankcase corresponding to the one end of the transmission shaft, is disposed rearward of both the clutch and the driven gear as viewed in a plane corresponding to the confronting surfaces of the upper crankcase and the lower crankcase.

5. The integrated power unit for the small vehicle as set forth in claim 1, wherein:

the power unit includes an engine and a transmission coupled to the engine;

the transmission further comprises an output shaft and plural speed change gear groups, the output shaft operatively connectable to the transmission shaft via one of the plural speed change groups, the transmission shaft is located at a position that is above and in front of the output shaft, and the output shaft is supported by and retained between the confronting surfaces of the upper crankcase and the lower crankcase at a location on a rear side of the crankshaft.

6. A vehicle, comprising:

an integrated power unit comprising:

a crankshaft;

a transmission shaft;

a crankcase, the crankcase being split into an upper crankcase and a lower crankcase;

a crank chamber within the crankcase, the crankshaft rotatably supported within the crank chamber and having an axis which is oriented in a transverse direction which is orthogonal to a forward travel direction of the vehicle;

a transmission chamber within the crankcase on the rear side of the crank chamber, the transmission shaft rotatably supported within the transmission chamber; and a clutch which permits connection and disconnection of power of the crankshaft to and from the transmission shaft, the clutch disposed at one end of the transmission shaft, wherein respective confronting surfaces of the upper crankcase and the lower crankcase are provided with plurality of fastening boss portions arranged as vertically opposed pairs, the upper crankcase and the lower crankcase are fastened together by fastening respective vertically opposed pairs of the fastening boss portions using fastening bolts so as to integrate the upper crankcase and the lower crankcase into a single entity, and wherein rearmost fastening boss portions of the plurality of fastening boss portions are located so as to be vertically overlapping with a rear portion of the clutch;

wherein the vehicle further comprises a vehicle body frame upon which the integrated power unit is mounted; and a swing arm pivotally mounted to the vehicle body frame and rotatable about a pivot axis, and wherein the pivot axis is disposed adjacent a rear side of the crankcase at a location adjacent to the rearmost fastening boss portions, and underlying a portion of the upper crankcase.

7. The vehicle of claim 6, wherein the crankshaft is rotatably supported between the respective confronting surfaces of the upper crankcase and the lower crankcase, the crankshaft comprising at least one crankpin connecting at least one pair of crank webs; and wherein the crankshaft has a drive gear provided thereon, and wherein the clutch comprises:

a driven gear, the driven gear meshed with the drive gear provided on the crankshaft; and a clutch mechanism;

wherein the outside diameter of the driven gear is greater than the outside diameter of the clutch mechanism; and wherein one of the rearmost fastening boss portions is substantially aligned, along said transverse direction, with said at least one crank pin.

8. The vehicle of claim 7, wherein the crankshaft comprises four pairs of crank webs, and wherein the one of the rearmost fastening boss portions is disposed adjacent to a transverse side of the crankcase corresponding to the one end of the transmission shaft.

9. The vehicle of claim 6, wherein the power unit further comprises a drive gear provided on the crankshaft, and wherein the clutch comprises:

a driven gear, the driven gear meshed with the drive gear provided on the crankshaft; and a clutch mechanism, wherein the outside diameter of the driven gear is greater than the outside diameter of the clutch mechanism; and one of the rearmost fastening boss portions, provided at an end of the crankcase corresponding to the one end of the transmission shaft, is disposed rearward of both the clutch and the driven gear as viewed in a plane corresponding to the confronting surfaces of the upper crankcase and the lower crankcase.

10. The vehicle of claim 6, wherein:

the transmission further comprises an output shaft and plural speed change gear groups, the output shaft operatively connectable to the transmission shaft via one of the plural speed change groups, the transmission shaft is located at a position that is above and in front of the output shaft, and the output shaft is supported by and retained between the confronting surfaces of the upper crankcase and the lower crankcase at a location on the rear side of the crankshaft.

11. An integrated power unit for a small vehicle, the power unit comprising:

a crankshaft;

a transmission shaft;

a crankcase, the crankcase being split into an upper crankcase and a lower crankcase;

a crank chamber within the crankcase, the crankshaft rotatably supported within the crank chamber and having an axis which is oriented in a transverse direction which is orthogonal to a forward travel direction of the vehicle;

a transmission chamber within the crankcase on the rear side of the crank chamber, the transmission shaft rotatably supported within the transmission chamber; and a clutch which permits connection and disconnection of power of the crankshaft to and from the transmission shaft, the clutch disposed at one end of the transmission shaft, wherein respective confronting surfaces of the upper crankcase and the lower crankcase are provided with plurality of fastening boss portions arranged as vertically opposed pairs, the upper crankcase and the lower crankcase are fastened together by fastening respective vertically opposed pairs of the fastening boss portions using fastening bolts so as to integrate the upper crankcase and the lower crankcase into a single entity, and wherein rearmost ones of the plurality of fastening boss portions are located so as to be vertically overlapping with a rear portion of the clutch, and the one end of the crankshaft projects outwardly beyond the clutch in the transverse direction.

12. The integrated power unit for a small vehicle as set forth in claim 11, wherein the crankshaft is rotatably supported between the respective confronting surfaces of the upper crankcase and the lower crankcase, the crankshaft comprising at least one crankpin connecting at least one pair of crank webs; and wherein the crankshaft has a drive gear provided thereon, and wherein the clutch further comprises:

a driven gear, the driven gear meshed with the drive gear provided on the crankshaft; and a clutch mechanism;

wherein an outside diameter of the driven gear is greater than an outside diameter of the clutch mechanism; and wherein one of the rearmost fastening boss portions is substantially aligned, along said transverse direction, with said at least one crank pin.

13. The integrated power unit for the small vehicle as set forth in claim 12, wherein the crankshaft comprises four pairs of crank webs, and wherein the one of the rearmost fastening boss portions is disposed adjacent to a transverse side of the crankcase corresponding to the one end of the transmission shaft.

14. The integrated power unit for the small vehicle as set forth in claim 11, wherein the power unit farther comprises a drive gear provided on the crankshaft, and wherein the clutch comprises:

a driven gear, the driven gear meshed with the drive gear provided on the crankshaft; and a clutch mechanism, wherein the outside diameter of the driven gear is greater than the outside diameter of the clutch mechanism; and one of the rearmost fastening boss portions, provided at an end of the crankcase corresponding to the one end of the transmission shaft, is disposed rearward of both the clutch and the driven gear as viewed in a plane corresponding to the confronting surfaces of the upper crankcase and the lower crankcase.

15. The integrated power unit for the small vehicle as set forth in claim 11, wherein:

the transmission further comprises an output shaft and plural speed change gear groups, the output shaft operatively connectable to the transmission shaft via one of the plural speed change groups, the transmission shaft is located at a position that is above and in front of the output shaft, and the output shaft is supported by and retained between the confronting surfaces of the upper crankcase and the lower crankcase at a location on the rear side of the crankshaft.

16. The integrated power unit for the small vehicle as set forth in claim 11, wherein the rearmost fastening boss portions are set at a position near a rear corner portion of the crankcase.

* * * * *